US005992195A

United States Patent [19]

Huang et al.

[11] Patent Number: 5,992,195

[45] Date of Patent: Nov. 30, 1999

[54] LEVER HANDLE CONTROLLER FOR MORTISE LOCK

[75] Inventors: Richard Hai Huang, New Haven; Darren C. Eller, East Lyme; Thomas A. Pelletier, Wallingford, all of Conn.

[73] Assignee: Sargent Manufacturing Corporation, New Haven, Conn.

[21] Appl. No.: 09/231,153

[22] Filed: Jan. 15, 1999

[51] Int. Cl.[6] ..... E05B 55/04

[52] U.S. Cl. ..... 70/472; 70/218; 70/149; 70/117; 292/DIG. 27; 292/169.22

[58] Field of Search ..... 70/472, 224, 218, 70/467, 468, 469, 471, 484, 485, 487, 489, 149, 153, 110, 107; 292/DIG. 27, 169.16, 169.22, 336.5, 336.3

[56] References Cited

U.S. PATENT DOCUMENTS

| | | | |
|---|---|---|---|
| D. 268,003 | 2/1983 | Ohno | D8/302 |
| D. 279,647 | 7/1985 | Ohno | D8/302 |
| 2,577,216 | 12/1951 | Spinello | 70/149 |
| 2,785,916 | 3/1957 | Mutti | 292/144 |
| 3,159,993 | 12/1964 | Crepinsek | 70/107 |
| 3,808,849 | 5/1974 | Alexander | 70/149 |
| 3,898,822 | 8/1975 | Schalm | 70/143 |
| 3,948,066 | 4/1976 | Solovieff | 70/129 |
| 3,990,277 | 11/1976 | Mullich | 70/107 |
| 4,108,482 | 8/1978 | Dietrich et al. | 292/165 |
| 4,286,812 | 9/1981 | Sprekeler | 292/245 |
| 4,384,738 | 5/1983 | Floyd | 292/92 |
| 4,536,020 | 8/1985 | Thomson | 292/173 |
| 4,583,382 | 4/1986 | Hull | 70/107 |
| 4,631,944 | 12/1986 | Gater et al. | 70/472 |
| 4,695,082 | 9/1987 | Marks | 292/169.16 |
| 4,696,174 | 9/1987 | Marks | 70/451 |
| 4,926,664 | 5/1990 | Gartner et al. | 70/119 |
| 5,002,322 | 3/1991 | Fukumoto | 292/341.16 |
| 5,018,375 | 5/1991 | Tully | 70/472 |
| 5,020,345 | 6/1991 | Gartner et al. | 70/277 |
| 5,027,629 | 7/1991 | Liu | 70/277 |
| 5,046,772 | 9/1991 | Su | 292/336.5 |
| 5,056,835 | 10/1991 | Johnson | 292/207 |
| 5,083,122 | 1/1992 | Clark | 340/825.32 |
| 5,421,178 | 6/1995 | Hamel et al. | 70/283 |
| 5,437,174 | 8/1995 | Aydin | 70/278 |
| 5,474,348 | 12/1995 | Palmer et al. | 292/339 |
| 5,542,274 | 8/1996 | Thordmark et al. | 70/495 |
| 5,715,715 | 2/1998 | Nunez | 70/283 |
| 5,788,296 | 8/1998 | Kuo et al. | 292/358 |
| 5,890,385 | 4/1999 | Lee | 70/472 |

FOREIGN PATENT DOCUMENTS

| | | | |
|---|---|---|---|
| 7284 | of 1898 | United Kingdom | 292/143 |

*Primary Examiner*—Darnell M. Boucher
*Assistant Examiner*—John B. Walsh
*Attorney, Agent, or Firm*—DeLio & Peterson, LLC

[57] ABSTRACT

A free-wheeling lever handle controller for operating a mortise lock provides free-wheeling functionality while maintaining the full operational characteristics of various mortise lock functions. A lock mode receiving mechanism connectable to the lock output is used to detect the unlocked and locked conditions of the mortise lock, and correspondingly engage and disengage the free-wheeling mechanism. The free-wheeling mechanism has a split shaft connected between a handle on the controller and a handle input on the mortise lock. The two halves of the shaft may be coupled and uncoupled via a shaft lock movable perpendicular between locked and unlocked positions. In the unlocked position the shaft lock connects the two halves of the shaft to rotate together when the handle is turned. In the locked position the shaft lock disengages the two halves of the shaft to rotate separately and allow the handle to free-wheel with operating the door latch. The shaft lock is moved by the lock slide/cam coupler of the lock mode receiving mechanism, which converts the rotational motion of the lock output into linear motion the of lock slide, such that whenever the mortise lock is locked, the handle controller free-wheels.

20 Claims, 5 Drawing Sheets

LEVER HANDLE CONTROLLER FOR MORTISE LOCK

BACKGROUND OF THE INVENTION

1. Field of the Invention

The present invention relates to handle controllers and trim sets for operating mortise lock mechanisms in which the handle is allowed to "free-wheel", i.e., rotate without retracting the latching mechanism when the mortise lock mechanism is locked.

2. Description of Related Art

Mortise locksets generally include the mortise lock and inner and outer handle controllers or trim sets which operate the mortise lock. The mortise lock is mortised into the door and usually includes the latching mechanism which secures the door to the door frame when the door is closed, as well as the locking mechanism which prevents the latching mechanism from being retracted when the door is locked.

The handle controllers are generally surface mounted on opposite sides of the door and have handles which operate the latching mechanism. In most current designs, the handle on each handle controller is directly connected to a shaft that extends into the mortise lock. The handle controllers also have some means of operating and controlling the lock mechanism in the mortise lock.

Most commonly, the outer handle controller will have a key-operated cylinder lock having a tail that extends through the back of the handle controller and into the mortise lock through the surface of the door. Turning the key rotates the cylinder lock tail which operates the locking mechanism within the mortise lock to lock it and prevent the handle from being turned.

In mortise lock designs of this type, the cylinder lock (or similar mechanical or electrical lock device) in the outer handle controller will connect (via the cylinder lock tail) to a lock input on the mortise lock. The lock input connects to and operates the locking mechanism within the mortise lock. The shaft extending from the handle connects to a handle input on the mortise lock to retract the latchbolt in the mortise lock when the mortise lock is not locked.

Locking the mortise lock will normally block rotation of the handle input or associated linkages between the handle input and the latching mechanism. Locking will also normally extend the deadbolt. When the mortise lock mechanism is not locked, with the deadbolt retracted, rotation of the handle input will retract the latchbolt and allow the door to be opened.

The handle input and the lock input are normally operable from either face of the mortise lock. This allows the mortise lock to be installed in both left and right hand hinged doors. These inputs are engaged by corresponding shafts or members that extend out of the back of the handle controllers and through openings in the face of the door. The handle input is usually driven by the handle shaft and the lock input by the tail on the lock cylinder. This design also allows the inner handle controller to share the handle input with the outer handle controller so that either handle may operate the door, when it is unlocked.

In addition to the lock input and the handle input, prior art mortise locks of the type described often include a third component, referred to herein as the "lock output", extending through the mortise lock case with ends that may be engaged by corresponding components in the inner and/or outer handle controllers. The lock output component is connected inside the mortise lock to the lock mechanism, ultimately including the lock input and the deadbolt. The lock output moves between a locked indicating position and an unlocked indicating position.

When the lock input is moved between the locked position and the unlocked position, the lock output moves accordingly to indicate the locked or unlocked state of the mortise lock. As described, the operation of the lock input also drives the deadbolt. Although the lock output is driven by the lock input from within the mortise lock, it may also be driven directly from outside the mortise lock. This reverse drives the lock input and operates the deadbolt and locking mechanism in the same way that they are operated by the lock input.

In many designs, the inside handle controller includes a deadbolt throw lever which drives the lock output in this manner to lock and unlock the door from the inner side of the door. From the outer side of the door the outer handle controller locks and unlocks the door by driving the lock input.

As is the case with the lock input and handle input, the lock output component can be engaged from either side to facilitate reversing the lock mechanism. On the inner side of the door, the lock output is an "output" because it indicates the locked or unlocked state of the door (by the throw lever position) when the mortise lock is locked or unlocked from the outside of the door. The lock input also acts as a second lock input when the throw lever is moved to extend or retract the deadbolt. On the outside of the door, the lock output is most often not used, although some lock designs do use it to drive an indicator in the outer handle controller to indicate whether the door is locked or unlocked, or that the locked area is occupied or not occupied.

Although the lock input and lock output are described herein as separate elements, in some designs, they may be the same element and comprise a single piece that may be moved between the locked and unlocked positions by the lock cylinder and the throw lever.

The latching mechanism of this type of mortise lock will include one or more latches that extend between the door and the door frame. The latch may be a single conventional latchbolt or it may be one or more vertical rod latches extending out the top and/or bottom edge of the door. Regardless of the particulars of the latching mechanism, however, it normally includes a central operating point at the handle input to which the externally mounted handle controllers will connect. The handle input retracts the latchbolt and/or latch rods out of latching engagement with the door frame when a handle on the inner or outer handle mechanism is turned to open the unlocked door.

Up to now, in devices of this type the handle on each controller has been connected substantially directly to the latching mechanism, most often through a solid shaft, and the locking function of the mortise lock has been achieved by physically blocking the movement of components inside the mortise lock to which the handle shaft connects. The motion of these components is blocked when the door is locked, and turning a key in the outer handle controller disengages the blocking in the mortise lock via the lock input.

The prior art lock device described above has been a highly successful design when the handle is a conventional door knob. However, the advent of lever handles has placed greater demands on the strength and security of the mortise lock components. The outer handle controller, when provided with a lever handle is referred to as a lever handle controller, and the present invention generally relates to such devices, although it may also be used with conventional doorknob handle controllers.

Doors are much easier to open when the handle is shaped as a lever rather than a conventional round door knob. For this reason, lever handles are preferred in some applications, and they may be required under applicable regulations for certain doors in public buildings to facilitate access by the disabled and the elderly.

However, the lever shape of the door handle allows a large force to be applied to the locking mechanism of the door and to the mounting between the door and the locking mechanism. The greater leverage available from a lever handle may allow a vandal or thief to break the internal components of the door lock by standing or jumping on the lever end of the handle.

To address this problem, in other types of lock mechanisms, the handle and lock mechanism have been designed so that operating the lock will disengage the handle from the lock mechanism. This allows the handle to free-wheel or rotate without operating the lock and prevents the lever handle from being used to overstress the internal components of the lock.

However, free-wheeling designs have not heretofore been feasible in mortise locks because of the separation of the handle and lock cylinder in the outer handle controller from the locking and latching mechanisms inside the mortise lock itself. If the free-wheeling mechanism is incorporated inside the mortised portion, it means that the mortise lock portion must be redesigned. This is expensive, and there is limited room inside the mortise lock to accommodate the free-wheeling mechanism. This approach would also require replacing the expensive mortise lock unit in existing installations to provide free-wheeling functionality.

Alternatively, if the free-wheeling mechanism is incorporated inside the outer lever handle controller, it means that the mortise lock must control the free-wheeling mechanism of the outer handle controller so that the free-wheeling of the outside handle stops when the mortise lock is unlocked from the inside handle controller.

Bearing in mind the problems and deficiencies of the prior art, it is therefore an object of the present invention to provide a handle controller for operating a mortise lock which allows the handle to free-wheel when the door is locked, regardless of whether it is locked from the inside handle controller or the outer handle controller.

It is a further object of the present invention to provide a free-wheeling handle controller that may be used with a prior art mortise lock mechanism to add free-wheeling capability to existing mortise lock installations.

It is another object of the present invention to provide a free-wheeling handle controller in which the connection between the handle and shaft extending to operate the door latch is both rugged and reliable, yet relatively inexpensive, the connection allowing a relatively high level of torque to be transmitted through to the door latch from the handle when the door is unlocked.

Another object of the present invention to provide a free-wheeling handle controller having a lock, such as a cylinder lock or electronic lock, which controls the mortise lock and wherein the controller is controlled by the mortise lock to put the handle controller into free-wheeling operation.

Still other objects and advantages of the invention will in part be obvious and will in part be apparent from the specification.

SUMMARY OF THE INVENTION

The above and other objects, which will be apparent to those skilled in art, are achieved in the present invention which is directed to a free-wheeling handle controller for operating a mortise lock. The mortise lock to be controlled has a latchbolt, a lock input for changing the mortise lock from an unlocked to a locked condition, a lock output for outputting the unlocked or locked condition of the mortise lock and a handle input for retracting the latchbolt when the mortise lock is in the unlocked condition. The free-wheeling handle controller of the invention includes a body, a handle and a lock mounted to the body. The lock is connected to the lock input on the mortise lock to change the mortise lock from the unlocked to the locked condition.

The handle controller of the invention also includes a shaft mounted in the body which connects between the handle and the handle input of the mortise lock. The shaft has first and second halves that are rotationally connected together along an axis of the shaft. The first half shaft is rotated by the handle and the second half is shaped to connect to the handle input of the mortise lock.

The handle controller of the invention further includes a lock function receiver. The lock function receiver is connected to the lock output of the mortise lock and is movable by the lock output between unlocked and locked positions corresponding to the unlocked and locked conditions of the mortise lock. The lock function receiver operates a shaft lock and moves the shaft lock between unlocked and locked positions corresponding to the unlocked and locked conditions of the mortise lock.

In the unlocked position the shaft lock connects both the first and second halves of the shaft to rotate together when the handle is turned. In the locked position the shaft lock disengages the first and second halves of the shaft from each other so that they can rotate separately and allow the handle to free-wheel.

In the preferred design, the shaft lock slides perpendicular to the axis of the shaft and rotates with one of the halves of the shaft, preferably the half of the shaft that is normally connected to the door latch. In the most highly preferred embodiment, the shaft has a square cross section and the shaft lock includes a lock opening that receives the shaft. In the longitudinal direction of the shaft, the lock opening has two portions—a first portion for receiving the first half of the shaft (the end connected to the handle) and a second portion having a different cross sectional shape for receiving the second half of the shaft (the end connectable to the mortise lock).

The second portion of the lock opening has a rectangular cross section for receiving the end of the of the square shaft that connects to the door latch. When the shaft lock moves from the unlocked to the locked position, the shaft moves from a first end of the rectangular cross section to an opposite end of the rectangular cross section, but at both ends the rectangular cross section engages the square cross section of the shaft and prevents it from turning relative to the shaft lock. The first portion of the lock opening (which receives the end of the shaft attached to the handle) also has first and second ends, and these two ends of the first portion of the opening are aligned with the first and second ends of the second portion. The first end of this first portion has a cross sectional shape that prevents the first half of the shaft from rotating relative to the shaft lock. However, the second end of this portion of the lock opening is sufficiently wide to allow the first half of the shaft (connected to the handle) to rotate relative to the shaft lock.

In this way, the sliding motion of the shaft lock perpendicular to the axis of the shaft causes the lock opening to either 1) engage both ends of the shaft to lock them together and prevent them from rotating relative to one another (when the ends are in the corresponding first ends of the lock opening, or 2) disengage the two ends and allow them to rotate relative to one another (i.e., allow the handle to free-wheel) when the ends are in the corresponding second ends of the lock opening.

In another aspect of the invention, the shaft lock preferably includes a handle engagement portion which connects to the handle either directly or indirectly when the mechanism is unlocked. The handle engagement portion provides a good connection between the shaft lock and the handle so that the shaft lock will rotate with the handle when the shaft lock is in the unlocked position and higher torque forces can be transmitted through the shaft while minimizing the loads on the shaft lock. The handle engagement portion is preferably a pair of pins which engage a corresponding slot and notch in a cam attached to the first half of the shaft, near the handle.

In another aspect of the invention, the shaft lock is moved between the locked and unlocked positions by a lock slide which engages the shaft lock and slides relative to the body. In the most highly preferred embodiment of this aspect of the invention, the lock slide includes a hook and the shaft lock includes an arcuate groove that is engaged by the hook. The curvature of the groove permits the shaft lock to rotate relative to the lock slide while the lock slide and hook remain fixed relative to the body.

In yet another aspect of the invention the handle controller the lock function receiver is connected to a lock cam, the lock cam operating the lock slide to move the shaft lock from the locked to the unlocked positions. The lock slide is preferably provided with a pair of horizontal edges that the lock cam operates against. The lock slide may also be provided with vertical edges that engage a plate to guide the motion of the lock slide.

BRIEF DESCRIPTION OF THE DRAWINGS

The features of the invention believed to be novel and the elements characteristic of the invention are set forth with particularity in the appended claims. The figures are for illustration purposes only and are not drawn to scale. the invention itself, however, both as to organization and method of operation, may best be understood by reference to the detailed description which follows taken in conjunction with the accompanying drawings in which:

DESCRIPTION OF THE PREFERRED EMBODIMENTS

In describing the preferred embodiment of the present invention, reference will be made herein to FIGS. 1–6 of the drawings in which like numerals refer to like features of the invention.

Figure 1A:
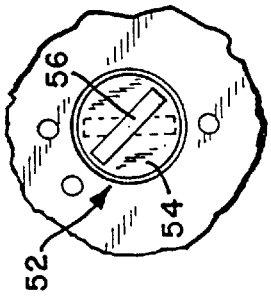
FIG. 1*a* front elevational detail view of the lock output of the handle controller of the present invention showing the two positions, locked and unlocked, of the lock output, the locked position being shown in solid lines and the unlocked position being shown in dashed lines.
Figure 1:
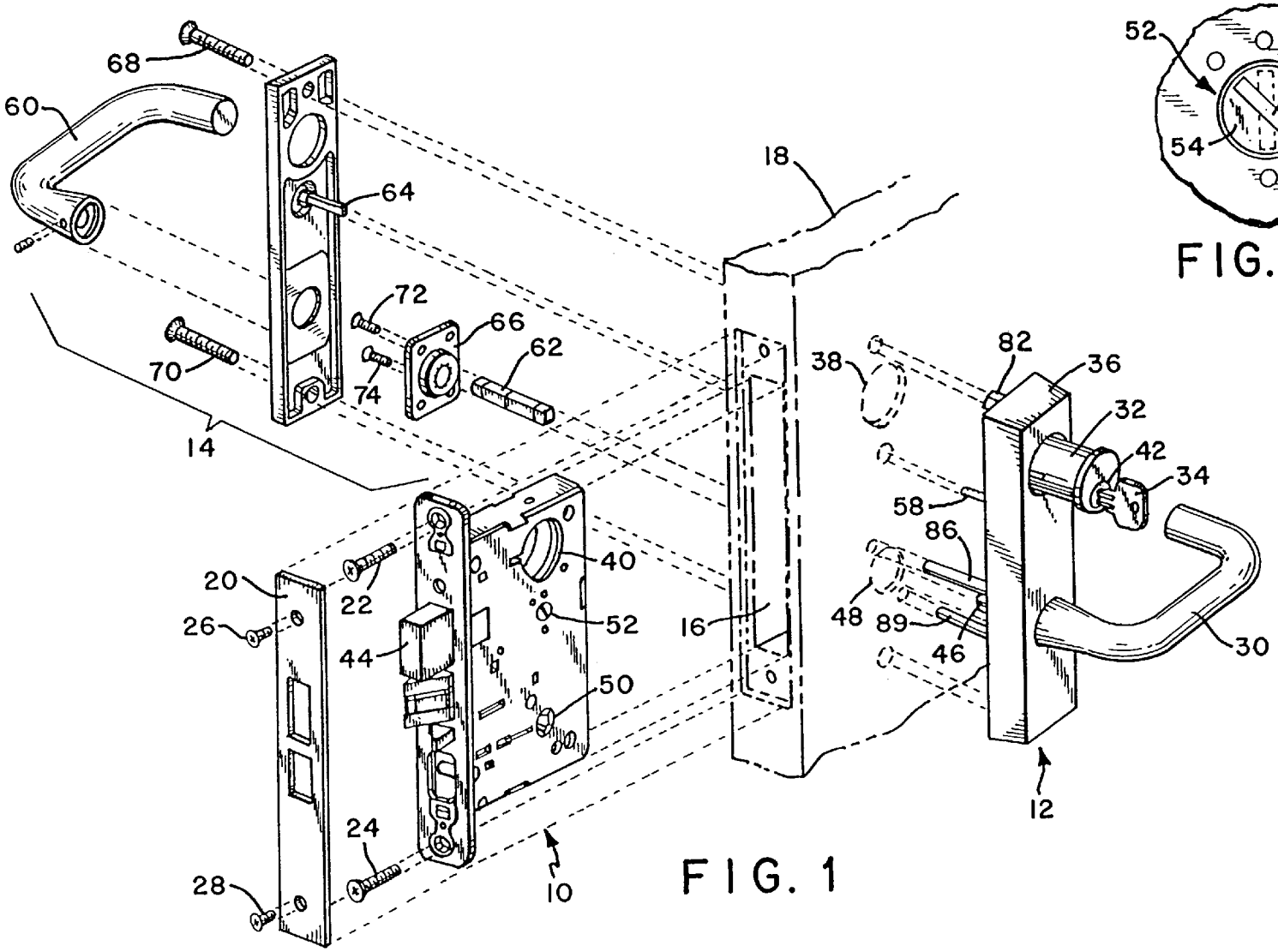
FIG. 1 is a perspective view of a disassembled mortise lockset, including a mortise lock, an inner lever handle controller and a free-wheeling outer lever handle controller according to the present invention, showing the relative placement of the mortise lockset components and the door (shown in phantom), prior to installation.

Referring to FIG. 1, a complete mortise-type lockset includes a mortise lock 10, an outer handle controller 12 which is constructed according to the present invention, and an inner handle controller generally indicated with reference numeral 14. The mortise lock 10 fits within a mortise opening 16 in door 18 and is covered by decorative plate 20.

The mortise lock 10 is held in door 18 with screws 22, 24 and these screws are covered by the decorative plate 20 which is held onto the edge of the mortise lock 10 with screws 26, 28. The mortise lock 10, as well as the inner handle controller 14, are substantially unchanged from the prior art, and no modifications are needed to these elements in order to provide free-wheeling operation when connected to the outer lever handle controller 12 of the present invention.

Lever handle controller 12 includes lever handle 30 and cylinder lock 32 operated by key 34. The handle 30 and the cylinder lock 32 are mounted in the lever handle controller body 36.

There are three functional connections between the lever handle controller 12 of the present invention and the mortise lock 10. The first of these is the cylinder lock 32 which extends through cylinder lock opening 38 in the door and into lock input 40 on the mortise lock 10. The cylinder lock 32 operates the lock input of the mortise lock 10 in exactly the method of the prior art. Rotation of key 34 turns cylinder 42 in cylinder lock 32 which operates a tail (seen in FIG. 3) located inside opening 40. Rotation of the key 34 in one direction causes the deadbolt 44 to be extended and locks the mortise lock 10. Rotation in the opposite direction retracts deadbolt 44 and unlocks the mortise lock mechanism.

The second connection between the outer lever handle controller 12 and the mortise lock 10 is through the handle shaft 46 which extends through handle shaft opening 48 in the door 18 and into the handle input 50 on the mortise lock.

The third operative connection between the handle controller 12 and the mortise lock 10 is at the lock output 52 on the mortise lock 10. The lock output 52 is shown in detail in FIG. 1*a*. The lock output 52 includes a rotatable piece 54 which extends through the mortise lock 10 from the inside to the outside and is pivoted in bearing holes in opposite faces of the mortise lock.

Rotatable piece 54 includes a blade slot 56 extending axially through the piece. The blade slot moves between the position shown in solid lines and the position shown in dotted lines in FIG. 1*a* when the mortise lock is switched from the locked state to the unlocked state. Lock output 52 is connected to lock function receiver 58 in the lever handle controller 12. The lock function receiver 58 is a blade-shaped shaft which is rotated about its axis by the lock output 52 whenever the mortise lock is switched from locked to unlocked.

The interaction of the lever handle controller 12 of the present invention and the mortise lock 10 occurs through the three connections referred to above, and may be summarized as follows. The key 34 turns the lock input 40 to lock and unlock the mortise lock. When the mortise lock 10 is locked or unlocked (either through key 34 or from the inner handle controller), it turns the lock output 52. The rotation of lock output 52 turns the lock function receiver 58 which switches the lever handle controller 12 between the free-wheeling and the non free-wheeling modes. In the non free-wheeling (unlocked) mode, turning the handle turns the handle shaft 46 which turns the handle input 50 and retracts the latchbolt. In the free-wheeling (locked) mode, turning the handle does not cause the handle shaft 46 to turn, and the door remains closed and locked even when the handle is turned.

The inner lever handle controller 14 is substantially unchanged from the prior art. It includes an inner lever handle 60 which turns inner handle shaft 62. The inner handle shaft extends into the opposite side of handle input 50 on the mortise lock 10. A throw lever (see FIG. 2) turns throw lever blade shaft 64 which extends into the lock output 52 on the opposite side from the connection with lock function receiver 58.

When the deadbolt throw lever on the inside is operated, it moves handle input 52 between the solid line position and the dashed line position in FIG. 1*a* and automatically engages and disengages the free-wheeling mechanism in the outer lever handle controller 12 via the lock function receiver 58. The inner lever handle 60 connects to piece 66 which turns the inner handle shaft 62. The entire mechanism is assembled in a conventional manner with screws 68, 70, 72 and 74.

Thus, a prior art mortise lock 10 and a prior art inner handle controller from an existing installation may be used with the free-wheeling lever handle controller of this invention to obtain a free-wheeling mortise lockset.

Figure 2:
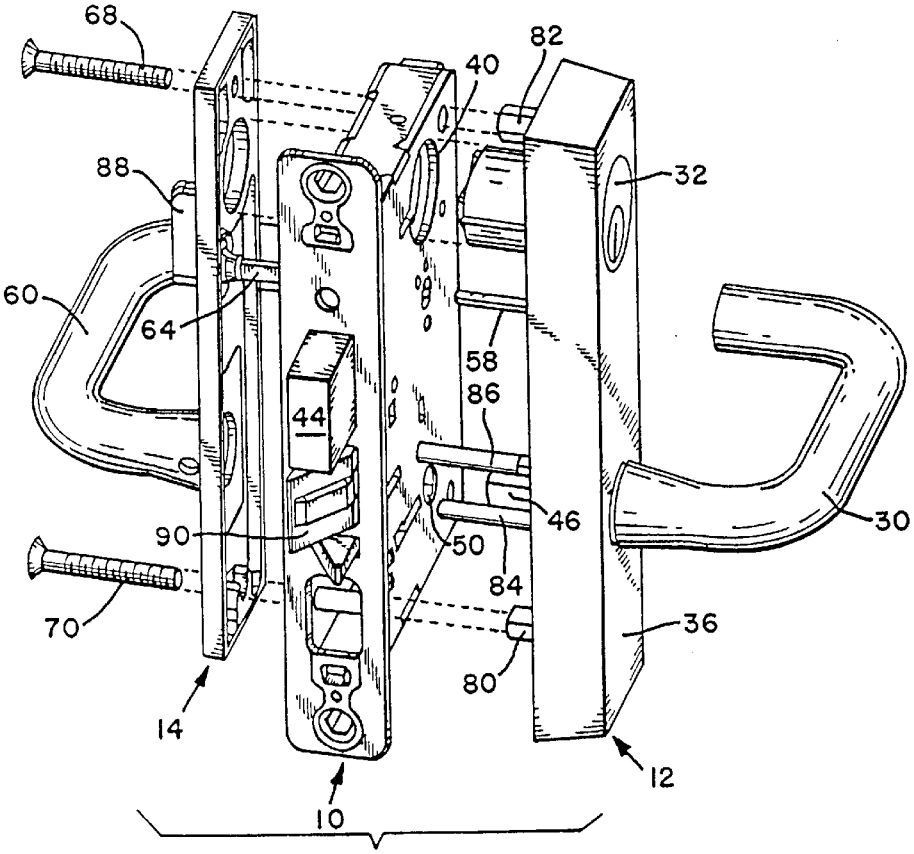
FIG. 2*a* perspective view of the mortise lockset seen in FIG. 1 shown in a nearly assembled relationship and illustrating the connection between the outer handle controller of this invention and the mortise lock. The door and the decorative plate on the edge of the mortise lock seen in FIG. 1 have been omitted for clarity.

FIG. 2 shows the principal elements of the inner and outer handle controllers and the mortise lock mechanism 10 in a nearly assembled condition. It can be seen that the lock cylinder 32 will extend into the lock input 40 when assembly is complete. This drawing shows a portion of the lock cylinder tail 76 (seen clearly in FIG. 3*b*) which is rotated by the key 34 to turn the lock input 40.

Studs 80, 82 on the body 36 of the outer lever handle controller 12 receive screws 68 and 70. Shafts 84, 86 are used for alignment and strength and extend through corresponding holes in the door as seen in FIG. 1.

Because the mortise lock 10 is unchanged from the prior art, when locked by cylinder lock 32 (or by turning the deadbolt throw lever 88), the handle input 50 is prevented from rotating regardless of whether the outer lever handle controller is a conventional non free-wheeling controller or a free-wheeling controller according to the present invention.

When the mortise lock mechanism 10 is unlocked (the deadbolt 44 is retracted in this condition) rotating the handle input 50, either through the inner handle 60 or the outer handle 30, causes the latchbolt 90 to be retracted so that the door can be opened.

Figure 3:
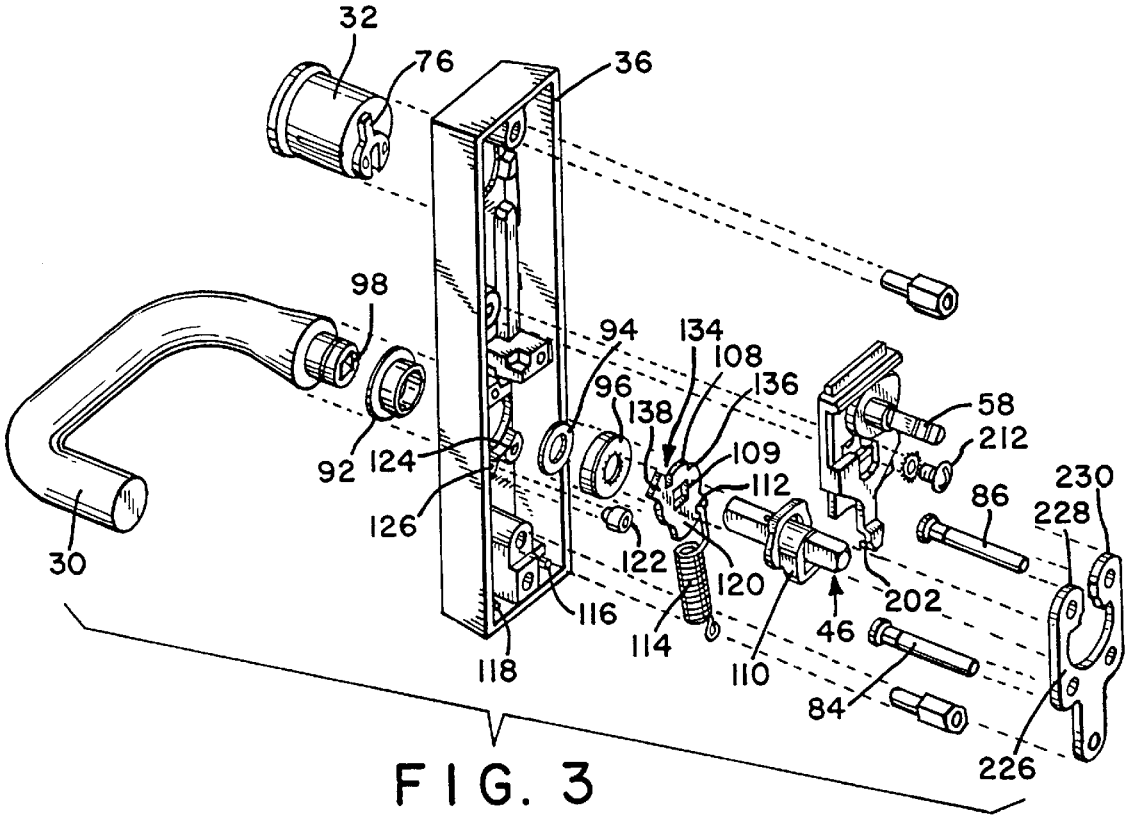
FIG. 3 is an exploded perspective view of the outer lever handle controller of the present invention.

FIG. 3 provides an exploded view of the mechanism of the present invention which allows the free-wheeling operation. It is drawn from the opposite perspective from the orientation shown in FIG. 1 to illustrate the components inside. Referring to FIG. 3, handle 30 extends through bearing 92 and body 36. It then extends through washer 94 where it is held by lock piece 96. Lock piece 96 holds it securely, but allows it to rotate relative to the body 36.

Handle 30 includes a square axial opening 98 which engages a first half 100 of a two piece handle shaft 46 which has a square cross section. As may be seen in FIG. 3*b*, the first half 100 of handle shaft 46 is free to rotate on inner shaft 104 relative to the second half 106 of the handle shaft. The first half shaft 100 is always turned by the handle. The second half shaft 106 connects to the handle input 50 of the mortise lock as previously described. Free-wheeling operation is achieved by connecting and disconnecting the two half shafts 100, 106 so that the handle may be connected to and disconnected from the handle input 50 on the mortise lock.

The first half shaft 100 extends through a square opening 109 in a handle cam 108. Because the square opening 109 in the handle cam is always directly connected to the first half shaft 100, rotation of the handle 30 always rotates the handle cam. The handle cam 108 includes a small opening 112 which is connected to spring 114, and spring 114 connects via either pin 116 or pin 118 to the body 36.

As may be seen in FIG. 3, a tab 120 on handle cam 108 acts as a stop when it contacts the head of stop screw 122. Spring 114 pulls down on the handle cam 108 at hole 112 which rotates the handle cam 108 and the first half 100 of the split shaft until the tab 120 contacts stop screw 122. This brings the lever handle 30 to the horizontal position. If the lock mechanism needs to be reversed for installation on a door of opposite swing, the handle cam 108 may be slipped off the half shaft and reversed. The handle is also reversed and the spring 114 is then connected to the opposite pin 118. The stop screw 122 is then moved from stop screw hole 126 to stop screw hole 124 so that the same functionality is achieved to bring the handle back to the horizontal.

The split shaft design and the components which connect and disconnect the two half shafts 100, 106 of the split shaft are distinctly different from prior art lock designs. Before describing these components in detail, it can simply be stated that the principal function of these components is to connect the two halves 100, 106 of the split shaft 46 so that turning one turns the other when the door is to be unlocked, and to disconnect the two halves and allow them to turn relative to each other when the door is to be locked.

When the two halves of the split shaft are connected together, rotation of the handle 30 will drive the second half 106 of the split shaft which turns the handle input 50 and retracts the latchbolt 90. On the other hand, when the two halves of the split shaft are allowed to turn relative to each other, turning the handle will not turn half shaft 106 and the handle 30 will free-wheel without retracting the latchbolt.

Various different types of mortise lock mechanisms may be operated by half shaft 106 with small modifications to the present invention. It may be desirable to connect the invention to a vertical rod door mechanism located inside a door or to an exit device or other mechanism located either inside the door or on the opposite side of the door from the handle controller of this invention.

Further, while the components described below provide the preferred embodiment of the invention, it should be understood that there are many variations upon the present design which are within the skill of those working in this field which will allow the first and second half 100 and 106 of the split shaft to be connected and disconnected, and such variations are to be considered within the scope of the present invention.

Although the first half shaft 100 is shown connected via an inner shaft 104 to the second half shaft 106, a ball and socket joint may also be used and other variations should be considered to be within the scope of the present invention.

Referring now to FIGS. 3 and 4*a*–4*c*, the coupling and uncoupling of the two halves 100 and 106 of the shaft 46 is principally accomplished by moving a shaft lock 110 perpendicular to the axis 128 of the shaft 46 between locked and unlocked positions. Shaft lock 110 includes a lock opening 170 that is approximately rectangular in shape, having two ends on opposite sides of dividing plane 178 and two portions on opposite sides of dividing plane 172. The shaft 46 extends through the lock opening and the lock opening is large enough in its long dimension to let the shaft lock move perpendicular to the axis 128 of the shaft 46 between the opposite ends.

When the shaft lock moves up (towards the lock cylinder 32) the shape of the opening 170 uncouples the two shaft halves 100, 106. This lets the handle free-wheel. When the shaft lock 110 slides down (away from the cylinder lock 32), the shape of the opening 170 holds the two half shafts 100, 106 coupled together. When the shaft lock is in this position, rotation of the handle rotates the second half shaft 106 and the shaft lock 110, as well as the first half shaft 100.

Figure 4A:
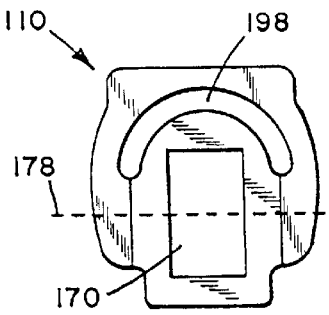
FIG. 4*a* is a back elevational view of the shaft lock component of the present invention.
Figure 4B:
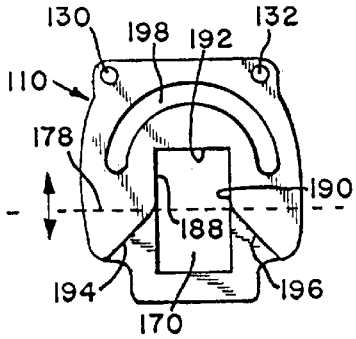
FIG. 4*b* is a front elevational view of the shaft lock component seen in FIG. 4*a*.
Figure 4C:
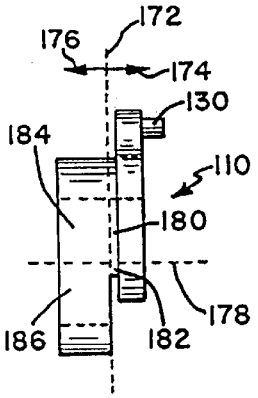
FIG. 4*c* is a left side elevational view of the shaft lock component seen in FIG. 4*a*.

Referring to the three views of FIGS. 4*a*–4*c*, the lock opening 170 can be seen in detail. The shaft lock 110 is positioned relative to the shaft 46 such that the joint between the first half shaft 100 and second half shaft 106 lies exactly in plane 172 of FIG. 4*c*. Plane 172 divides the lock opening 170 into two portions. The first half shaft 100 lies on the side of this plane indicated with arrow 174 and the second half shaft 106 lies on the side indicated with arrow 176. The half shafts remain on their respective sides of plane 172 regardless of how the shaft lock slides as its motion remains entirely in plane 172, either by sliding perpendicular to axis 128 of the shaft 46 or by rotating about that axis with the shaft.

Plane 178, which is perpendicular to plane 172, also divides the lock opening in half. Except when the shaft lock 110 is sliding between the locked and unlocked positions, the shaft 46 lies entirely on one side or the other of plane 178. In the locked (free-wheel) position, the shaft 46 is below plane 178. In the unlocked position, the shaft 46 is above plane 178. It is constrained to move fully and completely between locked and unlocked positions by the connection to the mortise lock which includes internal elements designed to constrain the mortise lock to shift completely between these positions.

Planes 172 and 178 divide the lock opening into four quadrants, 180, 182, 184 and 186, seen best in FIG. 4*c*. Quadrants 184 and 186 surround the second half shaft 106 and quadrants 180 and 182 surround the first half of the shaft 100. Motion of the shaft lock from the locked to the unlocked position causes half shaft 100 to move from quadrant 182 to 180 and half shaft 106 to move from quadrant 186 to 184. It is the shapes of these quadrants of the lock opening which control the relative rotation of the two halves of the shaft 46.

As may been seen best in FIG. 4*a*, the second portion of the lock opening, i.e. the portion containing quadrants 184 and 186 and which receives the second half shaft 106, is exactly rectangular in shape and has a width just sufficient to receive the square shaft 106. The sliding motion of shaft lock 110 from the unlocked position to the locked position moves the second half shaft 106 from the top end (quadrant 184) to the bottom end (quadrant 186) of the first portion of the lock opening 170. From this, it will be understood that the shaft lock 110 always turns with the second half shaft 106, just as the handle cam 108 always turns with the first half shaft 100.

FIG. 4*b* shows the cross sectional shape of the first portion of the lock opening i.e. the portion on side 174 of plane 172 and the side which receives the first half shaft 100. The upper or first end of this portion (quadrant 180) is approximately square in cross sectional shape having three sides which contact and engage the square cross sectional shape of half shaft 100 when the shaft lock 110 is in the unlocked position.

When the mechanism is unlocked, with half shaft 100 in quadrant 180, the sides 188, 190 and 192 of quadrant 180 engage the first half shaft 100 and prevent the shaft lock from turning relative to the half shaft 100. Because the shaft lock always turns with half shaft 106, this couples the two halves together and allows the handle to drive the handle input and latching mechanism in the mortise lock.

When the mechanism is locked, with half shaft 100 in quadrant 182, however, the first half shaft 100 is not engaged by the shaft lock. Quadrant 180 opens outward in a V formed by sides 194 and 196 is wide enough that the half shaft 100 can rotate freely within quadrant 182. It is this quadrant which allows the relative rotation of the two halves of the shaft, as needed for free-wheeling operation.

Figure 3A:
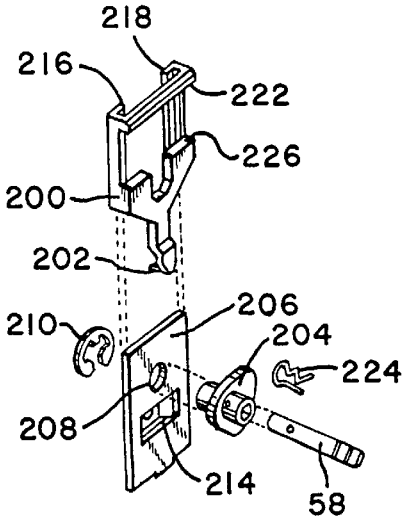
FIG. 3*a* is an exploded perspective view of the two-piece handle shaft and the shaft lock of the present invention, shown fully assembled in FIG. 3.
Figure 3B:
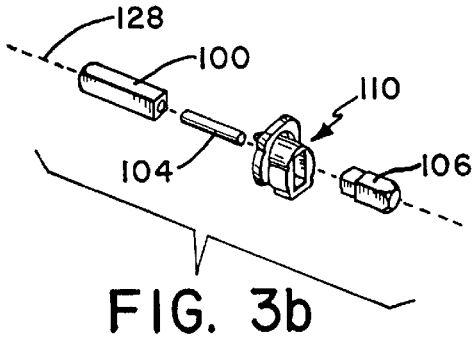
FIG. 3*b* is an exploded perspective view of the lock slide and related components shown fully assembled in FIG. 3.
Figure 5:
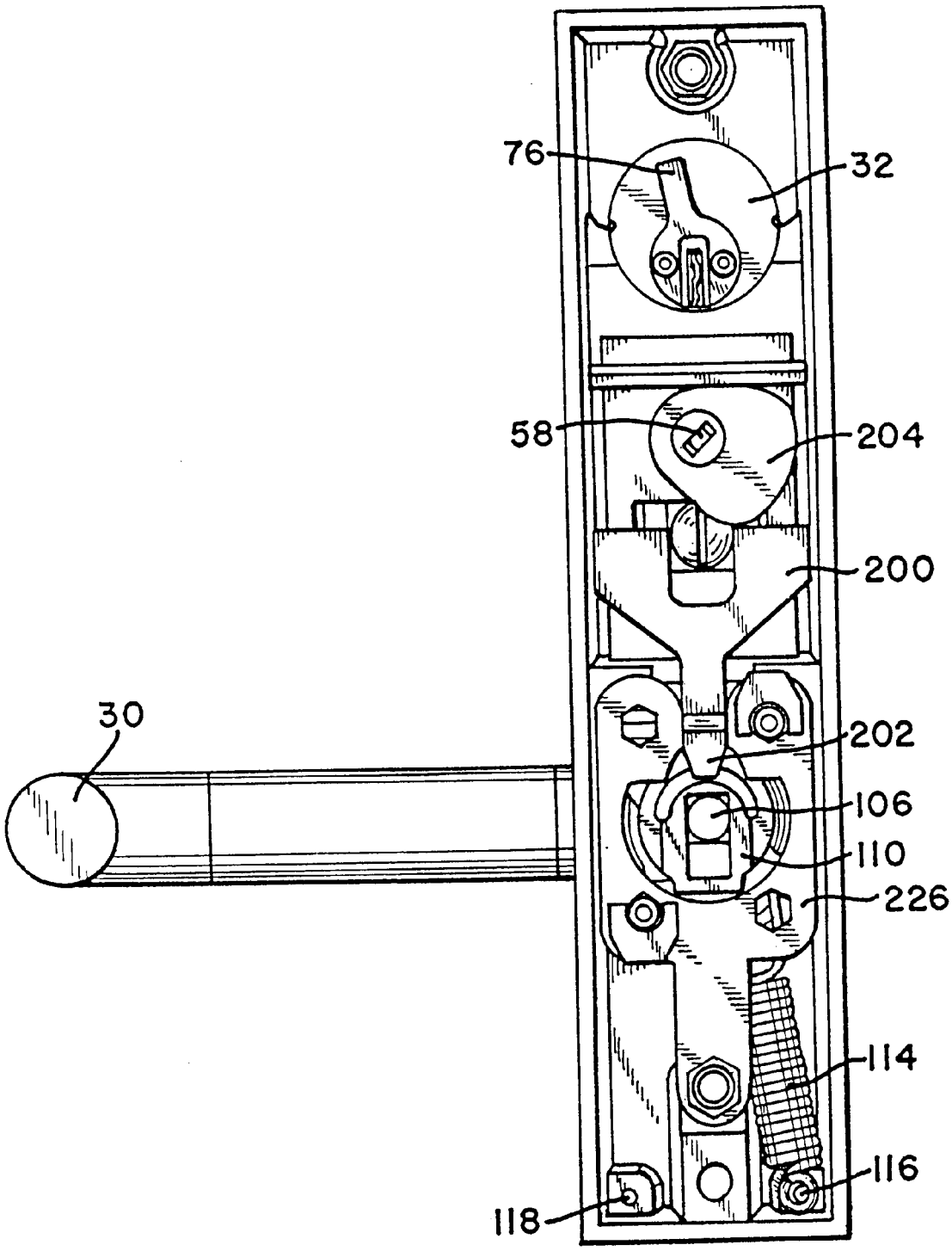
FIG. 5 is a back elevational view of the lever handle controller of the present invention.
Figure 6:
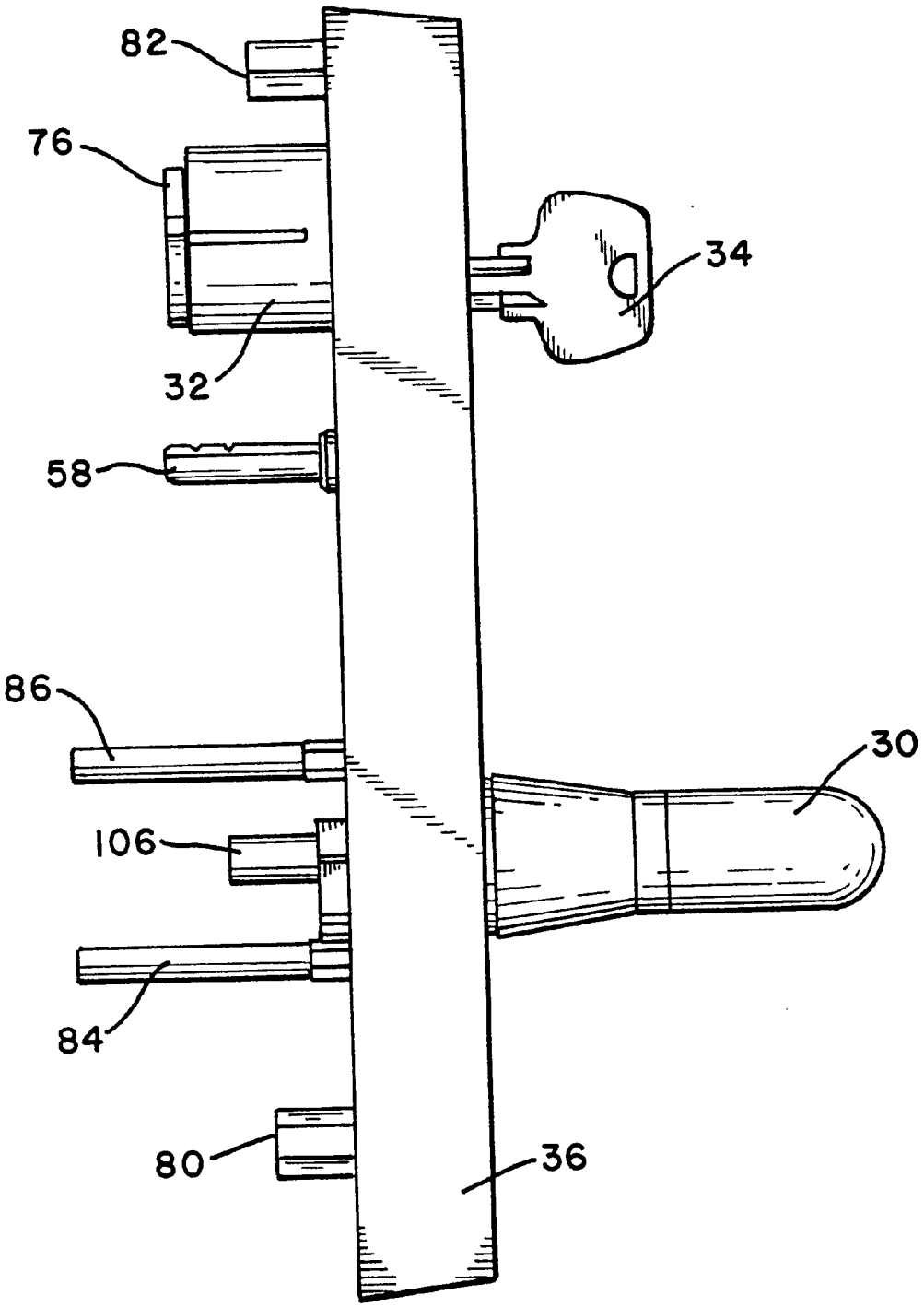
FIG. 6 is a side elevational view of the lever handle controller of the present invention.

The shaft lock 110 is moved between the unlocked position and the locked position by lock slide 200 (see FIG. 3 and particularly FIG. 3*a*). Lock slide 200 includes a hook 202 which engages an arcuate groove 198 (see FIGS. 4*a*–4*b*). Hook 202 pulls the shaft lock 110 upwards to free-wheel the handle (disconnect half shaft 100 from half shaft 106) or pushes it downwards when the mortise lock is unlocked (connect half shaft 100 to half shaft 106).

When the shaft lock 110 and lock slide 200 are down, the shaft lock 110 rotates when the handle is turned. The arcuate groove 198 allows the necessary relative rotation between the moving shaft lock and the stationary hook 202 and lock slide 200 which remain fixed relative to the body 36. Accordingly, arcuate groove 198 has a center of curvature which is approximately located on the axis of shaft 46 when it is in the upper or first end 180, 184 of the lock opening 170.

Referring to FIGS. 3 and 3*a*, the lock slide 200 is moved between the locked and unlocked positions by lock cam 204. Lock cam 204 is connected to lock function receiver 58 which is turned by the lock output 52 (see FIG. 1*a*) whenever the mortise lock is locked or unlocked.

The lock cam is rotationally attached to plate 206 through hole 208 by C-clip 210. Plate 206 is held to the body 36 by screw 212 whose head is indented below the principal plane of plate 206 in depression 214. This allows the lock slide to move freely up and down relative to the body 36 without interference from screw 212.

The lock slide 200 has a pair of vertical edges 216, 218 which engage the plate 206 such that the plate acts to guide the lock slide in its vertical motion. The lock cam 204 acts on a pair of horizontal edges 220, 222 on the lock slide (see also FIG. 5) to move the lock slide vertically whenever the lock function receiver 58 is turned by the lock output.

The lock function receiver 58 is attached to the lock cam with clip 224. Mounting plate 226 surrounds shaft lock 110

(see FIG. 5) and helps to guide the motion of the hook 202 between arms 228, 230.

When the key is inserted into the cylinder lock 32 and rotated, tail 76 rotates around and operates the lock input to lock the mortise lock in the conventional manner. This causes the lock output 52 to turn, which turns the lock function receiver 58 and rotates lock cam 204. In turn, this draws the lock slide upwards, pulling on the shaft lock via the hook 202 and arcuate groove 198, to move the shaft lock such that shaft 46 lies in quadrants 182 and 186 of the lock opening. This free-wheels the handle as previously described.

When the key is rotated in the opposite direction it unlocks the mortise lock and switches the lock output to the unlocked position. This turns the lock function receiver 58 the opposite direction and causes lock cam 204 to drive the lock slide down. This slides the shaft lock down such that the shaft extends through quadrants 180 and 184 and the two half shafts 100 and 106 are coupled together. The handle can now turn the second half shaft 106 which can operate the handle input and retract the latch mechanism inside mortise lock.

While the shaft lock 110 is sufficiently strong to couple the two shaft halves 100, 106 when they are turned by the handle, the preferred embodiment of this invention provides an additional feature on the shaft lock 110 which improves its performance. As illustrated in FIG. 3, a pair of pins 130, 132 which extend outwardly from the shaft lock 110, engage the handle cam in slot 134 and notch 136, respectively. The engagement between the pins and the slot/notch improves the connection between the handle cam and the shaft lock when the shaft lock is in the unlocked position.

First, the pins prevent the shaft lock 110 (which turns with the second half shaft 106) from moving into anything other than the correct aligned position relative to the handle cam (which turns with the first half shaft 100). Second, the pins improve the torque carrying connection between the shaft lock and the handle cam by improving the connection therebetween (As noted above, the handle cam always turns with half shaft 100, while the shaft lock 110 always turns with half shaft 106.)

In addition to the horizontal stop action of stop screw 122 with tab 120, stop screw 122 cooperates with stop surface 138 on the handle cam. The stop surface 138 on the handle cam contacts stop screw 122 when the handle has rotated to a desired limit (about 60 degrees) to prevent excessive rotation of the handle. This protects the hook 202 which is held in arcuate groove 198.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A free-wheeling handle controller for operating a mortise lock, the mortise lock having a latchbolt, a lock input for changing the mortise lock from an unlocked to a locked condition, a lock output for outputting the unlocked or locked condition of the mortise lock and a handle input for retracting the latchbolt when the mortise lock is in the unlocked condition, the free-wheeling handle controller comprising:

a body;

a handle;

a lock mounted to the body and connectable to the lock input to change the mortise lock from the unlocked to the locked condition;

a shaft mounted in the body, the shaft having first and second halves rotationally connected together along an axis of the shaft, the first half being rotated by the handle and the second half being adapted for connection to the handle input of the mortise lock;

a lock function receiver connectable to the lock output of the mortise lock and movable by the lock output between unlocked and locked positions corresponding to the unlocked and locked conditions of the mortise lock; and a shaft lock movable by the lock function receiver between unlocked and locked positions corresponding to the unlocked and locked conditions of the mortise lock, in the unlocked position the shaft lock connecting both the first and second halves of the shaft to rotate together when the handle is turned and in the locked position the shaft lock disengaging the first and second halves of the shaft to rotate separately and allow the handle to free-wheel.

2. The free-wheeling handle controller of claim 1 wherein the shaft lock slides perpendicular to the axis of the shaft.

3. The free-wheeling handle controller of claim 1 wherein the shaft lock rotates with one of the halves of the shaft.

4. The free-wheeling handle controller of claim 3 wherein the shaft lock rotates with the second half of the shaft.

5. The free-wheeling handle controller of claim 1 wherein the shaft lock includes a lock opening for receiving the shaft, the lock opening having a first portion for receiving the first half of the shaft and a second portion having a different cross sectional shape for receiving the second half of the shaft.

6. The free-wheeling handle controller of claim 5 wherein:

the shaft has a square cross section;

the second portion of the lock opening has a rectangular cross section for receiving the second half of the square shaft, the shaft moving from a first end of the rectangular cross section to an opposite end of the rectangular cross section as the shaft lock slides from the unlocked position to the locked position, the rectangular cross section having a width sufficiently narrow to prevent the second half of the shaft from rotating relative to the shaft lock; and the first portion of the lock opening has first and second ends aligned with the first and second ends of the second portion, the first end of the first portion having a cross sectional shape preventing the first half of the shaft from rotating relative to the shaft lock and the second end of the first portion allowing the first half of the shaft to rotate relative to the shaft lock.

7. The free-wheeling handle controller of claim 1 wherein the shaft lock includes a handle engagement portion, the handle engagement portion causing the shaft lock to rotate with the handle when the shaft lock is in the locked position.

8. The free-wheeling handle controller of claim 7 further including a handle cam rotated by the first half of the shaft whenever the handle is rotated, the handle engagement portion of the shaft lock engaging the handle cam when the shaft lock slides to the unlocked position.

9. The free-wheeling handle controller of claim 8 wherein the handle cam includes at least one slot and the handle engagement portion of the shaft lock includes at least one pin engaging the slot cam when the shaft lock slides to the unlocked position.

10. The free-wheeling handle controller of claim 9 wherein the handle cam includes stops contacting the base to limit rotational motion of the handle.

11. The free-wheeling handle controller of claim 9 wherein the handle is a lever handle and the handle controller further includes a spring connected to the handle cam to support the lever handle in a horizontal position.

12. The free-wheeling handle controller of claim 1 further including a lock slide engaging the shaft lock and sliding relative to the body, the lock slide being driven by the lock function receiver to move the shaft lock from the locked to the unlocked positions.

13. The free-wheeling handle controller of claim 12 wherein the lock slide includes a hook and the shaft lock includes an arcuate groove, the hook engaging the arcuate groove to permit the shaft lock to rotate relative to the lock slide.

14. The free-wheeling handle controller of claim 13 wherein the shaft lock rotates relative to the lock slide when the shaft lock is in the unlocked position and the shaft lock remains fixed relative to the lock slide when the shaft lock is in the locked position.

15. The free-wheeling handle controller of claim 13 wherein the arcuate groove has a center of curvature approximately aligned with the axis of the shaft when the shaft lock is in the unlocked position.

16. The free-wheeling handle controller of claim 12 wherein the lock function receiver is connected to a lock cam, the lock cam operating the lock slide to move the shaft lock from the locked to the unlocked positions.

17. The free-wheeling handle controller of claim 16 wherein the lock cam is positioned between a pair of horizontal edges on the lock slide, the lock cam camming against the horizontal edges to move the lock slide when the lock cam is turned.

18. The free-wheeling handle controller of claim 16 wherein the lock slide is guided by a plate and the lock cam is mounted to the plate.

19. The free-wheeling handle controller of claim 18 wherein the lock slide includes a pair of vertical edges, the vertical edges contacting the edges of the plate to guide the motion of the lock slide.

20. The free-wheeling handle controller of claim 19 wherein the plate includes a recess having a fastener connecting the plate to the body, the recess allowing the lock slide to freely slide over the fastener.

* * * * *

UNITED STATES PATENT AND TRADEMARK OFFICE

CERTIFICATE OF CORRECTION

PATENT NO. : 5,992,195
DATED : November 30, 1999
INVENTOR(S) : Richard H. Huang et al.

It is certified that error appears in the above-identified patent and that said Letters Patent is hereby corrected as shown below:

On the Title Page

In the Assignee, delete "Corporation" and substitute therefor - - Company - -.

In column 4, line 51, after "end" delete "of the".

In column 5, line 31, delete "the handle controller".

In column 5, line 43, after "drawn to scale." delete "the" and substitute therefor - - The - -.

In column 5, line 55, after "1a" insert - - is a - -.

In column 5, line 60, delete "2a" and substitute therefor - - 2 is a - -.

In column 9, line 65, delete "been" and substitute therefor - - be - -.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*